US009132903B1

(12) United States Patent
Gable et al.

(10) Patent No.: US 9,132,903 B1
(45) Date of Patent: Sep. 15, 2015

(54) SYSTEMS AND METHODS FOR LATERALLY MANEUVERING MARINE VESSELS

(71) Applicant: Brunswick Corporation, Lake Forest, IL (US)

(72) Inventors: Kenneth G. Gable, Oshkosh, WI (US); William R. Robertson, Oshkosh, WI (US); David M. Van Buren, Fond Du Lac, WI (US); Glenn E. Anderson, Merritt Island, FL (US); Brad E. Taylor, Guthrie, OK (US)

(73) Assignee: Brunswick Corporation, Lake Forest, IL (US)

( * ) Notice: Subject to any disclaimer, the term of this patent is extended or adjusted under 35 U.S.C. 154(b) by 24 days.

(21) Appl. No.: 14/038,494

(22) Filed: Sep. 26, 2013

Related U.S. Application Data

(60) Provisional application No. 61/764,105, filed on Feb. 13, 2013.

(51) Int. Cl.
*B63H 25/42* (2006.01)
*B63H 25/02* (2006.01)

(52) U.S. Cl.
CPC ..... *B63H 25/42* (2013.01); *B63H 25/02* (2013.01)

(58) Field of Classification Search
CPC ..... B63H 25/42
USPC ..... 114/144 R, 144; 440/84, 53; 701/21
See application file for complete search history.

(56) References Cited

U.S. PATENT DOCUMENTS 6,234,853 B1 * 5/2001 Lanyi et al. ..... 440/53
6,273,771 B1 * 8/2001 Buckley et al. ..... 440/84
6,684,803 B1 * 2/2004 Dickson ..... 114/144 R
6,994,046 B2 * 2/2006 Kaji et al. ..... 114/144 R
7,121,908 B2 * 10/2006 Okuyama ..... 440/84
7,220,153 B2 * 5/2007 Okuyama ..... 440/1
7,267,068 B2 * 9/2007 Bradley et al. ..... 114/144 R
7,305,928 B2 * 12/2007 Bradley et al. ..... 114/144 R
7,429,202 B2 * 9/2008 Yazaki et al. ..... 440/53
7,467,595 B1 * 12/2008 Lanyi et al. ..... 114/144 R
7,941,253 B1 * 5/2011 Brant ..... 701/21
8,113,892 B1 * 2/2012 Gable et al. ..... 440/84
8,272,906 B2 * 9/2012 Ito ..... 440/1
8,777,681 B1 * 7/2014 McNalley et al. ..... 440/53
8,807,059 B1 * 8/2014 Samples et al. ..... 114/144 R
2010/0191396 A1 7/2010 Nose et al.
2011/0106347 A1 * 5/2011 Itoi et al. ..... 701/21
2012/0184160 A1 * 7/2012 Dudra et al. ..... 440/63
2014/0106631 A1 * 4/2014 Ito ..... 440/1
2015/0032305 A1 * 1/2015 Lindeborg ..... 701/21

* cited by examiner

*Primary Examiner* — Lars A Olson
*Assistant Examiner* — Jovon Hayes
(74) *Attorney, Agent, or Firm* — Andrus Intellectual Property Law, LLP

(57) ABSTRACT

Systems and methods are for maneuvering a marine vessel having a plurality of steerable propulsion devices. The plurality of propulsion devices are controlled to achieve a lateral movement by controlling the steering orientation of port and starboard propulsion devices so that forward thrusts provided by the port and starboard propulsion devices intersect at or forwardly of a center of turn of the marine vessel. One of the port and starboard propulsion devices is operated to provide a forward thrust and the other of the port and starboard propulsion devices is operated to provide a reverse thrust so that the lateral movement is achieved and a resultant yaw component is applied on the marine vessel. An intermediate propulsion device is controlled to apply an opposing yaw component on the marine vessel that counteracts the resultant yaw component.

25 Claims, 11 Drawing Sheets

SYSTEMS AND METHODS FOR LATERALLY MANEUVERING MARINE VESSELS

CROSS-REFERENCE TO RELATED APPLICATION

This application claims the benefit of and priority to U.S. Provisional Patent Application No. 61/764,105, filed Feb. 13, 2013.

FIELD

The present disclosure relates to marine vessels and particularly to control systems for maneuvering marine vessels.

BACKGROUND

U.S. Pat. No. 6,234,853, which is hereby incorporated herein by reference in entirety, discloses a docking system which utilizes the marine propulsion unit of a marine vessel, under the control of an engine control unit that receives command signals from a joystick or push button device, to respond to a maneuver command horn the marine operator. The docking system does not require additional propulsion devices other than those normally used to operate the marine vessel under normal conditions. The docking or maneuvering system uses two marine propulsion units to respond to an operator's command signal and allows the operator to select forward or reverse commands in combination with clockwise or counterclockwise rotational commands either in combination with each other or alone.

U.S. Pat. No. 6,273,771, which is incorporated herein by reference in entirety, discloses a control system for a marine vessel, which incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,267,068, which is hereby incorporated herein by reference in entirety, discloses a marine vessel maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 7,305,928, which is hereby incorporated herein by reference in entirety, discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,467,595, which is hereby incorporated herein by reference in entirety, discloses a method for controlling the movement of a marine vessel, which rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

00081 U.S. patent application Ser. No. 13/157,128, which is hereby incorporated herein by reference in entirety, discloses a system for maneuvering a marine vessel, which comprises an input device for requesting a reverse thrust of a marine propulsion device and a control circuit that, based upon the request for the reverse thrust from the input device, controls movement of the marine propulsion device into a trim position wherein the marine propulsion device provides a reverse thrust that is not impeded by a hull of the marine vessel. Optionally, the input device can comprise a joystick.

U.S. patent application Ser. No. 13/227,578, which is hereby incorporated herein by reference in entirety, discloses systems for maneuvering a marine vessel. The systems comprise an input device for requesting lateral movement of the marine vessel with respect to the longitudinal axis and a plurality of propulsion devices including at least a port propulsion device, a starboard propulsion device and an intermediate propulsion device disposed between the port and starboard propulsion devices. A control circuit controls orientation of the port and starboard propulsion devices inwardly towards a common point on the marine vessel, and upon a request for lateral movement of from the input device, operates one of the port and starboard propulsion devices in forward gear, operates the other of the port and starboard propulsion devices in reverse gear, and operates the intermediate propulsion device in reverse gear.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

Systems are for maneuvering a marine vessel, that extends along a longitudinal axis from a bow to a stern. A plurality of steerable propulsion devices each generate forward and reverse thrusts that propel the marine vessel. The plurality of propulsion devices comprise a port propulsion device, a starboard propulsion device and at least one intermediate propulsion device located between the port and starboard propulsion devices. A control circuit controls steering orientation, magnitude of thrust, and direction of thrust of each propulsion device in the plurality. An input device inputs to the control circuit an operator's request for lateral movement of the marine vessel with respect to the longitudinal axis. The control circuit controls the plurality of propulsion devices to achieve the lateral movement, by (1) controlling the steering orientation of the port and starboard propulsion devices so that thrusts provided by the port and starboard propulsion devices extend along axes that intersect at or forwardly of a center of turn of the marine vessel, (2) operating one of the port and starboard propulsion devices to provide a forward thrust and operating the other of the port and starboard propulsion devices to provide a reverse thrust so that the lateral movement is achieved and a resultant yaw component is applied on the marine vessel during the lateral movement, and (3) operating the intermediate propulsion device to apply an opposing yaw component on the marine vessel that counteracts the resultant yaw component applied on the marine vessel by the port and starboard propulsion devices.

Methods are for maneuvering a marine vessel that extends along a longitudinal axis from a bow to a stern. The methods can comprise: (1) inputting to the control circuit an operator's request for lateral movement of the marine vessel with respect to the longitudinal axis, and (2) controlling the plurality of propulsion devices to achieve the lateral movement by controlling steering orientation of the port and starboard propulsion devices so that thrusts provided by the port and starboard propulsion devices extend along axes that intersect at or forwardly of a center of turn of the marine vessel, (3) operating one of the port and starboard propulsion devices to provide a forward thrust and operating the other of the port and starboard propulsion devices to provide a reverse thrust so that the lateral movement is achieved and a resultant yaw component is applied on the marine vessel during the lateral movement, and (4) operating the intermediate propulsion device to apply an opposing, yaw component on the marine vessel that counteracts the resultant yaw component applied, on the marine vessel by the port and starboard propulsion devices.

Further examples, including but not limited to marine vessels and methods of operation for marine vessels are also disclosed.

BRIEF DESCRIPTION OF THE DRAWINGS

Examples of methods and systems according to the present disclosure are described with reference to the following drawing figures. Like numbers are used throughout the drawing figures to reference like features and components.

DETAILED DESCRIPTION OF THE DRAWINGS

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims. Each limitation in the appended claims is intended to invoke, interpretation under 35 U.S.C. §112 only if the terms "means for" or "step for" are explicitly recited in the respective limitation.

Figure 5:
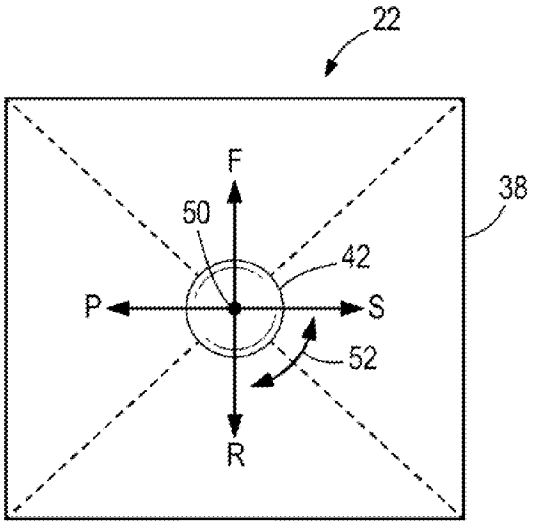
FIG. 5 is a top view of the joystick.
Figure 6:
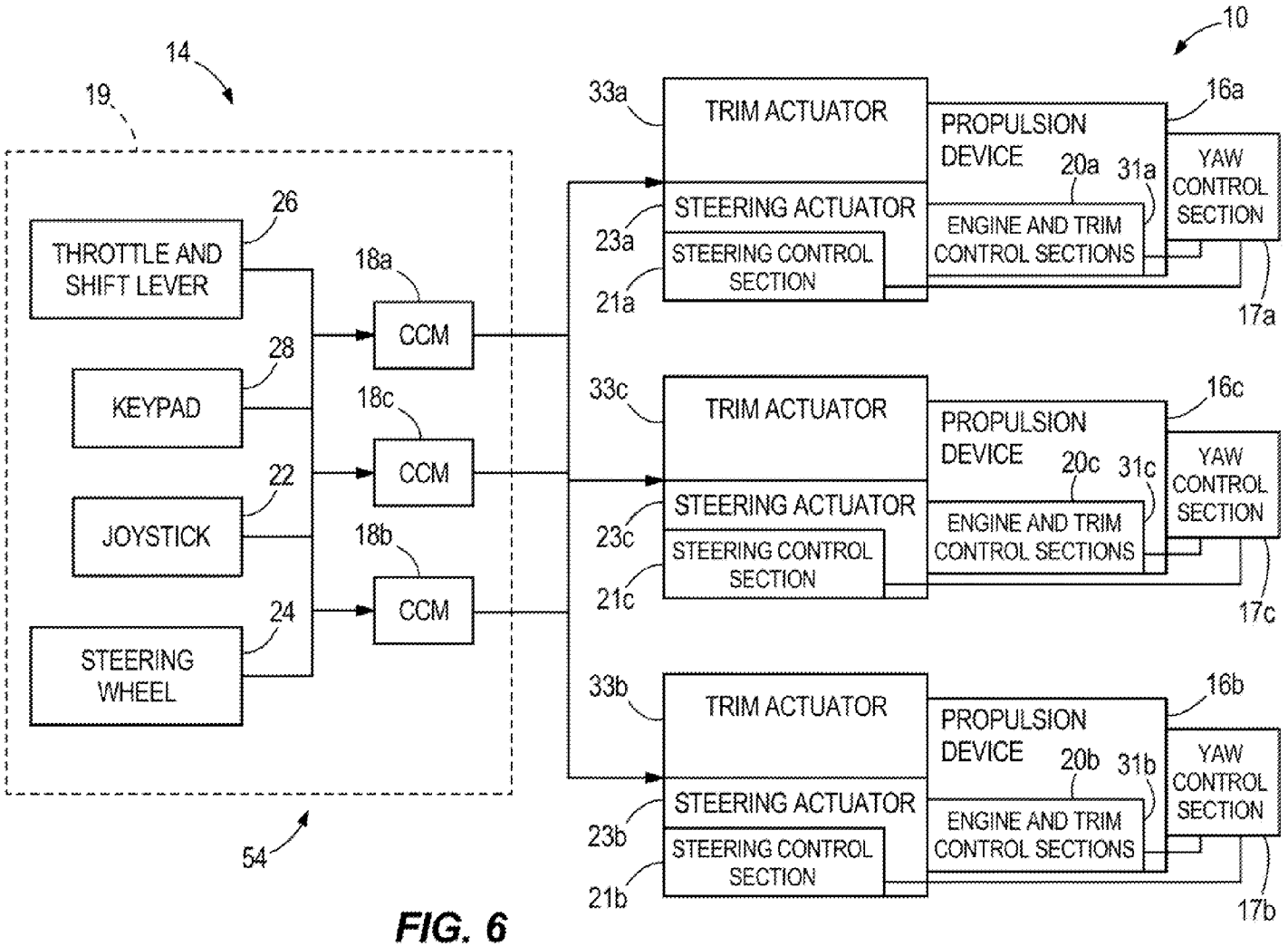
FIG. 6 is a schematic depiction of a control circuit for controlling three marine propulsion devices.
Figure 7:
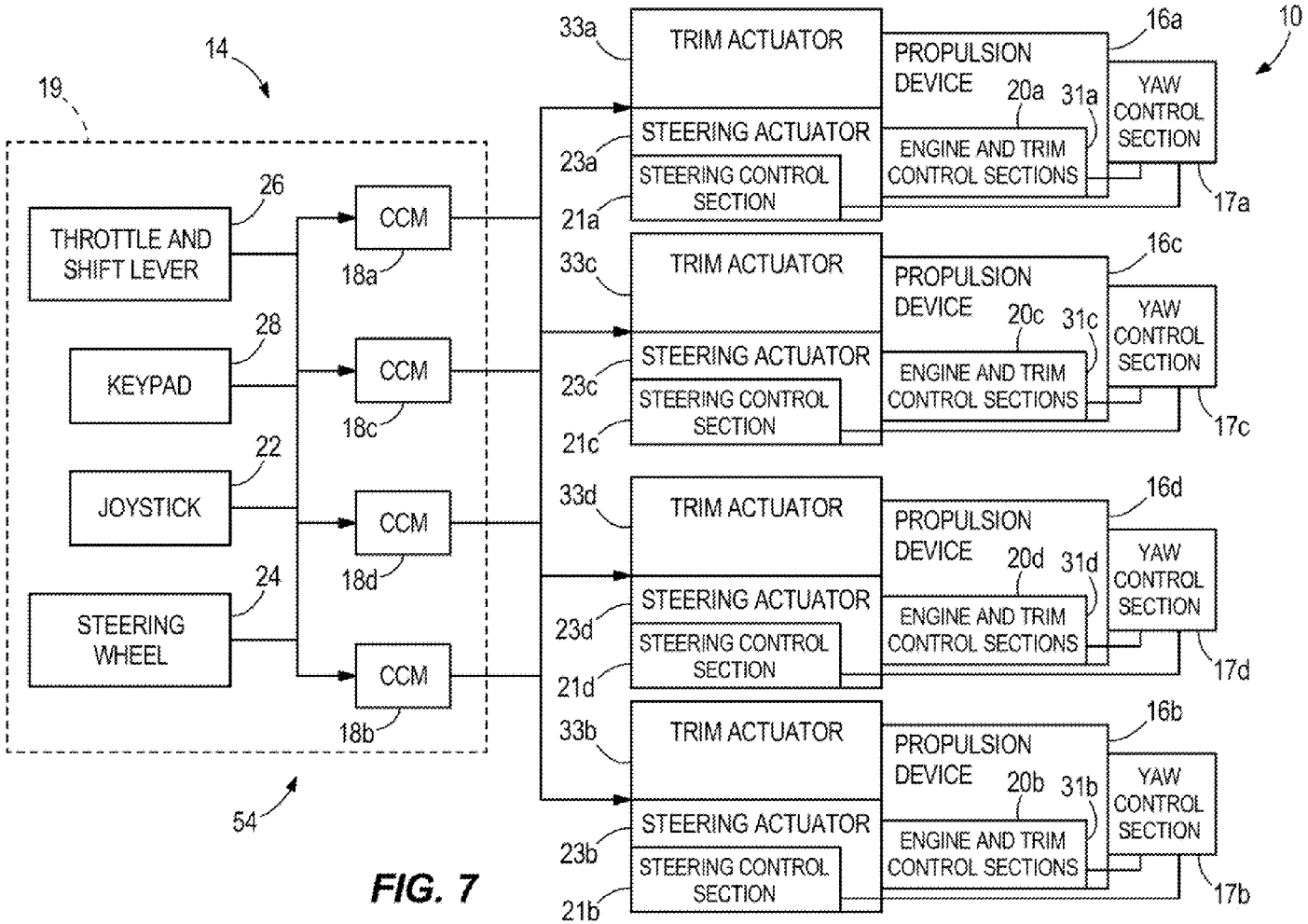
FIG. 7 is a schematic depiction of a control circuit for controlling four marine propulsion devices.

FIGS. 1-7, 9 and 11 depict components of systems 10 for maneuvering and orienting a marine vessel 12. The system 10 includes, among other things, a control circuit 14 (see e.g. FIGS. 6 and 7) for controlling the rotational position, trim position, and thrust generation of a plurality of marine propulsion devices 16*a*, 16*b*, 16*c*, and optionally 16*d* based upon inputs from an input device. FIG. 6 shows the control circuit 14 for a three-propulsion device arrangement, whereas FIG. 7 shows the control circuit 14 for a four-propulsion device arrangement. It should be understood that the particular configurations of the system 10 and marine vessel 12 are exemplary. It is possible to apply the concepts described in the present disclosure with substantially different configurations for systems for maneuvering and orienting marine vessels and with substantially different marine vessels.

For example, the control circuit 14 (see e.g. FIGS. 6 and 7) is shown in schematic form and has a plurality of command control sections 18*a*, 18*b*, 18*c*, and optionally 18*d* located at a helm 19 of the marine vessel 12 that communicate with respective engine control sections 20*a*, 20*b*, 20*c*, and optionally 20*d* associated with each marine propulsion device 16*a*, 16*b*, 16*c*, 16*d* steering control sections 21*a*, 21*b*, 21*c*, and optionally 21*d* associated with steering actuators 23*a*, 23*b*, 23*c*, and optionally 23*d* for steering each marine propulsion device 16*a*, 16*b*, 16*c*, 16*d*; and trim control sections 31*a*, 31*b*, 31*c*, and optionally 31*d*, associated with trim actuators 33*a*, 33*b*, 33*c*, and optionally 33*d* for changing, the trim angles of each marine propulsion device 16*a*, 16*b*, 16*c*, 16*d*. However, the control circuit 14 can have any number of sections (including for example one section) and can be located remotely from or at different locations in the marine vessel 12 from that shown. For example, the trim control sections 31*a*, 31*b*, 31*c*, 31*d* can be co-located with and/or part of the engine control sections 20*a*, 20*b*, 20*c*, 20*d* (as shown); or can be located separately from the respective engine control sections 20*a*, 20*b*, 20*c*, 20*d*. Other similar modifications of this type can be made. It should also be understood that the concepts disclosed in the present disclosure are capable of being implemented with different types of control systems, including systems that acquire global position data and real time positioning data, such as for example global positioning systems, inertial measurement units, and/or the like.

Further, certain types of input devices such as a joystick 22, a steering wheel 24, a shift/throttle lever 26, and a keypad. 28 are described. It should be understood that the present disclosure is applicable with other numbers and types of input devices such as video screens, touchscreens, voice command modules, and the like. It should also be understood that the concepts disclosed in the present disclosure are able to function in a preprogrammed format without user input or in conjunction with different types of input devices, as would be known to one of ordinary skill in the art. Further equivalents, alternatives and modifications are possible as would be recognized by one of ordinary skill in the art.

Further, the examples shown, marine vessels 12 have three (i.e. port, intermediate and starboard) and four (i.e. port, intermediate port, intermediate starboard and starboard) marine propulsion devices; however, the concepts of the present disclosure are applicable to marine vessels having more than two marine propulsion devices. Configurations with more than four marine propulsion devices are contemplated. Parts of this disclosure and claims refer to a "propulsion device". These descriptions are intended to equally apply to arrangements having "one or more propulsion devices." The concepts in the present disclosure are also applicable to marine vessels having any type or configuration of propulsion device, such as for example electric, motors, internal combustion engines, and/or hybrid systems configured as an inboard drive, outboard drive, inboard/outboard drive, stern drive, and/or the like. The propulsion devices can include any different type of propulsor such as propellers, impellers, pod drives and/or the like.

Figure 2:
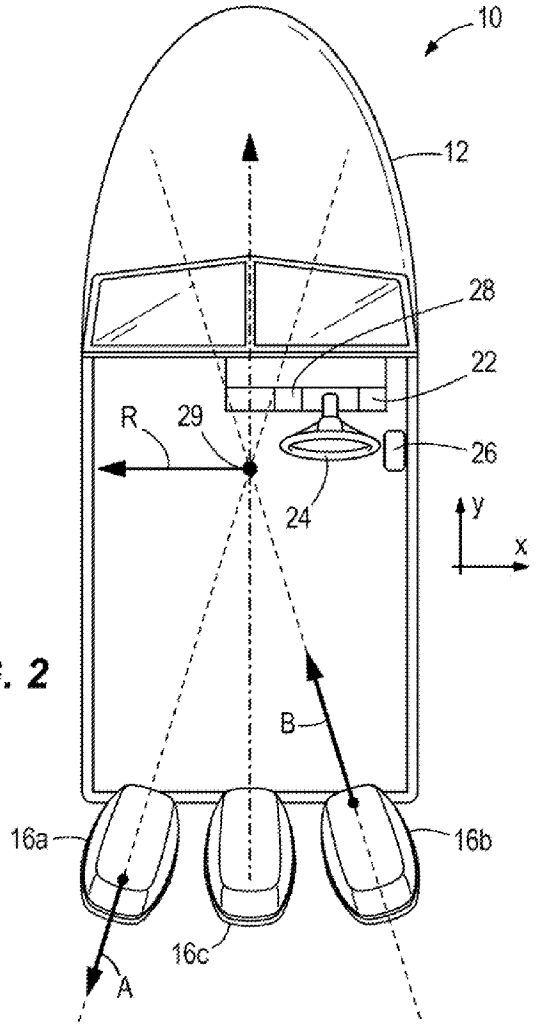
FIG. 2 is schematic depiction of a marine vessel having the plurality of marine propulsion devices wherein port and starboard propulsion devices are oriented inwardly towards a common point so as to provide thrusts that are both oriented along axes that intersect with the common point.
Figure 1:
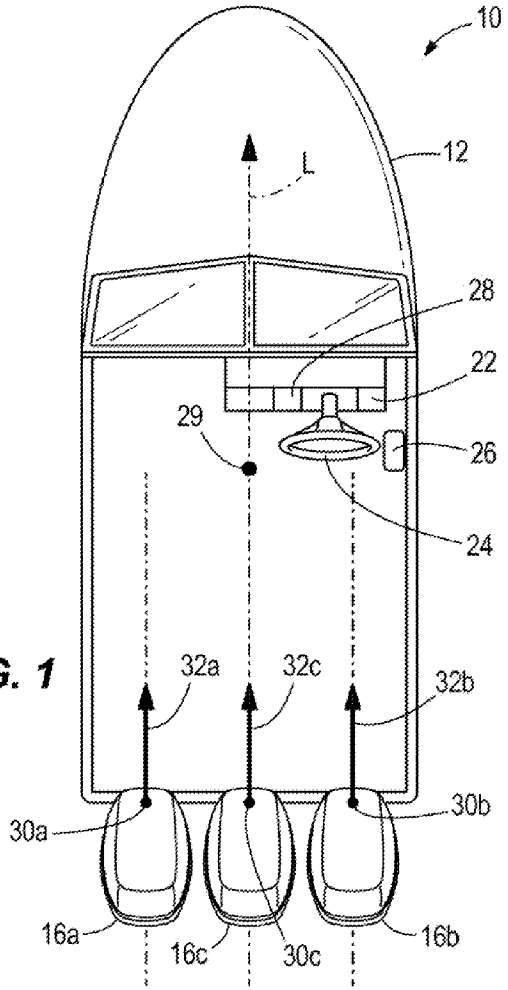
FIG. 1 is a schematic depiction of a marine vessel having a plurality of marine propulsion devices oriented in an aligned position wherein the propulsion devices can provide forward and reverse thrusts that are oriented along axes that are parallel to a longitudinal axis of the marine vessel.

In FIGS. 1 and 2, a marine vessel 12 is schematically illustrated and has port, starboard and intermediate propulsion devices 16*a*, 16*b*, 16*c*, which in the example shown are outboard internal combustion engines. Again, the type and number of propulsion devices can vary from that shown. The intermediate propulsion device 16*c* is disposed between the port and starboard propulsion devices 16*a*, 16*b*. As used in this description and the appended claims, the term "disposed between" is to be given its broadest possible meaning, including arrangements wherein the intermediate propulsion device is located fore or all of one or both of the port and starboard propulsion devices 16*a*, 16*b*. The term "disposed between" also includes arrangements wherein the intermediate propulsion device 16*c* is located at different elevation from the port and starboard devices 16*b*, 16*c*. The term "disposed between" also includes arrangements wherein the intermediate propulsion device 16*c* is located closer to one of the port and starboard devices 16*a*, 16*b* than the other of the port and starboard devices 16*a*, 16*b*. The marine propulsion devices 16*a*, 16*b*, 16*c* are each rotatable in clockwise and counterclockwise directions through a substantially similar range of rotation about respective steering axes 30*a*, 30*b*, 30*c*. Rotation of the marine propulsion devices 16*a*, 16*b*, 16*c* is facilitated by conventional steering actuators 23*a*, 23*b*, 23*c* (see FIG. 6). Steering actuators for rotating marine propulsion devices are well known in the art, examples of which are provided in U.S. Pat. No. 7,467,595, the disclosure of which is hereby incorporated by reference in entirety. Each marine propulsion device 16*a*, 16*b*, 16*c* creates propulsive thrust in both forward and reverse directions. FIG. 1 shows the marine propulsion devices 16*a*, 16*b*, 16*c* operating, in forward gear, such that resultant forwardly acting thrust vectors 32*a*, 32*b*, 32*c* on the marine vessel 12 are produced however, it should be recognized that the propulsion devices 16*a*, 16*b*, 16*c* could also be operated in reverse gear and thus provide oppositely oriented (and/or reversely acting) thrust vectors on the vessel 12.

As shown in FIG. 1, the propulsion devices 16*a*, 16*b*, 16*c* are aligned with a longitudinal axis L to thereby define the thrust vectors 32*a*, 32*b*. 32*c* extending in the direction of longitudinal axis L. The particular orientation of propulsion units 16*a*, 16*b*, 16*c* shown in FIG. 1 is typically employed to achieve a forward or backward movement of the marine vessel 12 in the direction of the longitudinal axis L or a rotational movement of the vessel 12 with respect to the longitudinal axis L. Specifically, operation of the propulsion devices 16*a*, 16*b*, 16*c* in forward gear causes the marine vessel 12 to move forwardly in the direction of the longitudinal axis L. Conversely, operation of propulsion devices 16*a*, 16*b*, 16*c* in reverse gear causes the marine vessel 12 to move reversely in the direction of the longitudinal axis L. Further, operation of one of propulsion devices 16*a*, 16*b* in forward gear and the other in reverse gear causes rotation (yaw) of the marine vessel 12 about a center of turn 29 for the marine vessel 12. In this example intermediate propulsion device 16*b* is shifted into neutral gear. These and other various other maneuvering strategies and mechanisms are described in the incorporated U.S. Pat. Nos. 6,234,853; 7,267,068; and 7,467,595.

In this example, the center of turn 29 represents an effective center of gravity for the marine vessel 12. However it will be understood by those having ordinary skill in the art that the location of the center of turn 29 is not, in all cases, the actual center of gravity of the marine vessel 12. That is, the center of turn 29 can be located at a different location than the actual center of gravity that would be calculated by analyzing the weight distribution of various components of the marine vessel 12. Maneuvering a marine vessel 12 in a body of water results in reactive forces exerted against the hull of the marine vessel 12 by the wind and the water. For example, as various maneuvering thrusts are exerted by the marine propulsion devices 16*a*, 16*b*, 16*c*, the hull of the marine vessel 12 pushes against the water and the water exerts a reaction force against the hull. As a result, the center of turn identified at 29 in FIGS. 1 and 2 can change in response to different sets of forces and reactions exerted on the hull of the marine vessel 12. This concept is recognized by those skilled in the art and is referred to as the instantaneous center of turn in U.S. Pat. No. 6,234,853; and as the instantaneous center in U.S. Pat. No. 6,994,046, which are incorporated herein by reference.

As shown in FIG. 2, the marine propulsion devices 16*a* and 16*b* are rotated out of the aligned position shown in FIG. 1 so that the marine propulsion devices 16*a*, 16*b* and their resultant thrust vectors 32*a*, 32*b* are not aligned parallel with each other and with the longitudinal axis L. In the example shown in FIG. 2, the marine propulsion devices 16*a*, 16*b* are splayed inwardly and operated so as to provide thrust vectors 32*a*, 32*b* that extend along axes that transversely intersect with a common point, which in this example is the center of turn 29. In addition to the example shown in FIG. 2, various other transversely oriented, unaligned positions and relative different or the same amounts of thrust of the marine propulsion devices

16*a*, 16*b* are possible to achieve one or both of a rotational movement and movement of the marine vessel 12 in any direction, including transverse to and parallel to the longitudinal axis L.

The marine vessel 12 also includes a helm 19 (see e.g. FIGS. 6 and 7) where a user can input commands for maneuvering the marine vessel 12 via one or more input devices. As discussed above, the number and type of input devices can vary from the example shown. In FIGS. 1 and 2, the input devices include the joystick 22, steering wheel 24, shift and throttle lever 26 and keypad 28. Rotation of the steering wheel 24 in a clockwise direction requests clockwise rotation or yaw of the marine vessel 12 about the center of turn 29. Rotation of the steering wheel 24 in the counter-clockwise direction requests counterclockwise rotation or yaw of the marine vessel 12 about the center of turn 29. Forward pivoting of the shift and throttle lever 26 away from the neutral position requests forward gear and requests increased throttle. Rearward pivoting of the shift and throttle lever 26 away from a neutral position requests reverse gear and requests increasing rearward throttle. Actuation of the keypad 28 inputs user-requested operational mode selections to the control circuit 14.

Figure 3:
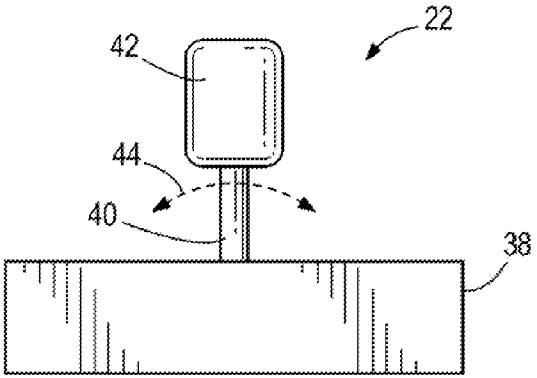
FIG. 3 is a side view of an input device in the form of a joystick.
Figure 4:
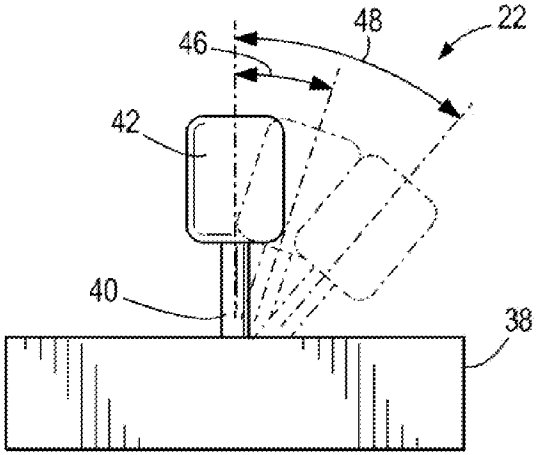
FIG. 4 is a view like FIG. 3 showing movement of the joystick.

A schematic depiction of a joystick 22 is depicted in FIGS. 3-5. The joystick 22 includes a base 38, a shaft 40 extending vertically upwardly relative to the base 38, and a handle 42 located on top of the shaft 40. The shaft 40 is movable, as represented by dashed-line arrow 44 in numerous directions relative to the base 38. FIG. 4 illustrates the shaft 40 and handle 42 in three different positions which vary by the magnitude of angular movement. Arrows 46 and 48 show different magnitudes of movement. The degree and direction of movement away from the generally vertical position shown in FIG. 3 represents an analogous magnitude and direction of an actual movement command selected by a user. FIG. 5 is a top view of the joystick 22 in which the handle 42 is in a central, vertical, or neutral position. The handle 42 can be manually manipulated in a forward F, reverse R, port P or starboard S direction or a combination of these to provide actual movement commands into F, R, P, S directions or any other direction therebetween. In addition, the handle 42 can be rotated about the centerline 50 of the shaft 40 as represented by arrow 52 to request rotational movement or yaw of the vessel 12 about the center of turn 29. Clockwise rotation of the handle 42 requests clockwise rotation of the marine vessel 12 about the center of turn 29, whereas counterclockwise rotation of the handle 42 requests counterclockwise rotation of the vessel about the center of turn 29. These and various other joystick structures and operations are described in the incorporated U.S. Pat. Nos. 6,234,853; 7,267,068; and 7,467,595.

Referring to FIGS. 6 and 7 the input devices 22, 24, 26 and 28 communicate with the control circuit 14, which in the example shown is part of a control circuit area network 54. It is not required that the input devices 22, 24, 26 and 28 communicate with the control circuit 14 via the control circuit area network 54. For example, one or more of these items can be connected to the control circuit 14 by hard wire or wireless connection. The control circuit 14 is programmed to control operation of marine propulsion devices 16*a*, 16*b*, 16*c*, 16*d* and the steering actuators and trim actuators associated therewith. As discussed above, the control circuit 14 can have different forms. In the example shown, the control circuit 14 includes a plurality of command control sections 18*a*, 18*b*, 18*c*, 18*d* located at the helm 19. A command control section 18*a*, 18*b*, 18*c*, and optionally 18*d* is provided for each of the port, starboard and intermediate marine propulsion devices 16*a*, 16*b*, 16*c*, 16*d*. The control circuit 14 also includes engine control sections 20*a*, 20*b*, 20*c*, 20*d* located at and controlling operation of each respective propulsion device 16*a*, 16*b*, 16*c*, 16*d*; a steering control section 21*a*, 21*b*, 21*c*, 21*d*; located at and controlling operation of each steering, actuator 23*a*. 23*b*, 23*c*, 23*d* and a trim control section 31*a*, 31*b*, 31*c*, 31*d* located at the respective engine control sections 20*a*, 20*b*, 20*c*, 20*d* and controlling operation of each trim actuator 33*a*, 33*b*, 33*c*, 33*d*. In another example, the trim control sections 31*a*, 31*b*, 31*c*, 31*d* can be located apart from the engine control sections 20*a*, 20*b*, 20*c*, 20*d* respectively. In the present disclosure, the control circuit 14 also includes yaw control sections 17*a*, 17*b*, 17*c*, and optionally 17*d* for operating one or more of the propulsion devices 16*a*, 16*b*, 16*c*, 16*d* to apply an opposing yaw component on the marine vessel 12 for maintaining a sidle translation without bow rotation, or optionally adding bow rotation, as will be discussed further here and below. As with the other control sections, the yaw control sections 17*a*, 17*b*, 17*c*, 17*d* can be separate control sections, or can be formed by a combination of features provided by other control sections, such as the noted steering control sections and engine control sections. In another example, the yaw control sections 17*a*, 17*b*, 17*c*, 17*d* can be comprised of computer code stored within and read by one or more of the other respective control sections. The location and physical configuration of the yaw control sections 17*a*, 17*b*, 17*c*, 17*d* can vary, as would be understood by those having ordinary skill in the art. Each control section discussed herein optionally can have a memory and a processor for sending and receiving electronic control signals, for communicating, with other control circuits in the control circuit area network 54, and for controlling operations of certain components in the system 10 such as the operation and positioning of marine propulsion devices and related steering actuators and trim actuators. The structure and electrical connections of this type of system is within the skill of one having ordinary skill in the art, and is described in the incorporated U.S. Pat. No. 6,273,771. Examples of programming and operations of the control circuit 14 and its sections are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure.

In the example shown, each command control section 18*a*, 18*b*, 18*c*, 18*d* receives user inputs via the control circuit area network 54 from the joystick 22, steering wheel 24, shift and throttle lever 26, and keypad 28. As stated above, the joystick 22, steering wheel 24, shift and throttle lever 26, and keypad 28 can be wired directly to the command control sections 18*a*, 18*h*, 18*c*, 18*d* or via the control circuit area network 54. Each command control section 18*a*, 18*b*, 18*c*, 18*d* is programmed to convert the user inputs into electronic commands and then send the commands to other control circuit sections in the system 10, including the engine control sections 20*a*, 20*b*, 20*c*, 20*d* and related steering control sections and trim control sections. For example, when the shift and throttle lever 26 is actuated, as described above, each command control section 18*a*. 18*b*, 18*c*, 19*d* sends commands to the respective engine control sections 20*a*, 20*b*, 20*c*, 20*d* to achieve the requested change in throttle and/or shift. Rotation of the shift and throttle lever in the aftward direction will request reverse shift and thrust of the marine propulsion devices 16*a*, 16*b*, 16*c*, 16*d* to achieve reverse movement of the marine vessel 12. Further, when the steering, wheel 24 is actuated, as described above, each command control section 18*a*, 18*b*, 18*c*, 18*d* sends commands to the respective steering control sections 21*a*, 21*b*,

21*c*, 21*d* to achieve the requested change in steering. When the joystick 22 is moved out of its vertical position, each command control section 18*a*, 18*b*, 18*c*, 18*d* sends commands to the respective engine control sections 20*a*, 20*b*, 20*c*, 20*d* and/or steering control sections 21*a*, 21*b*, 21*c*, 21*d* to achieve a movement commensurate with the joystick 22 movement. Depending upon the direction of movement of the joystick 22, one or more yaw control sections 17*a*, 17*b*, 17*c*, 17*d* can operate to affect bow rotation, as discussed further herein below. When the handle 42 of the joystick 22 is rotated, each command control section 18*a*, 18*b*, 18*c*, 18*d* sends commands to the respective steering control section 21*a*, 21*b*, 21*c*, 21*d* to achieve the requested vessel yaw or rotation. Movement of the joystick 22 out of its vertical position effectively engages a "joystick mode" wherein the control circuit 14 controls operation and positioning of the marine propulsion devices 16*a*, 16*b*, 16*c*, 16*d* based upon movement of the joystick 22. In another example, "joystick mode" can be actuated by user input to the keypad 28 or other input device.

In the incorporated U.S. patent application Ser. No. 13/227,578, filed Sep. 8, 2011, it is disclosed that through experimentation, it has been determined that lateral maneuvering capabilities of marine vessels are often limited by the relatively lower thrust capabilities of the one of the port or starboard propulsion device that is operating in the reverse gear. Such systems often cannot efficiently utilize the maximum thrust capacity of the forwardly operating device while still achieving the requested lateral thrust vector. This is because propellers generally provide less thrust in reverse than forward. This becomes a serious problem in cases where a large lateral thrust is necessary to achieve a lateral movement of the vessel.

Through further experimentation, the present inventors have determined that because of typical mechanical and design space limitations for propulsion devices, the outermost port and starboard propulsion devices in prior art systems often cannot sufficiently rotate about their respective steering axes far enough to direct thrust at, and/or aft of the center of turn of the marine vessel. Instead, the outermost propulsion devices typically are only capable of pivoting so that thrusts provided by the propulsion devices extend along axes that intersect at the center of turn or at a common point that is located forward of the center of turn. In these situations, as discussed herein below with respect to FIGS. 8A, 8B and 10A, 10B, when the operator manually operates the joystick to request certain transverse movements of the marine vessel in the port and standard directions, thrusts provided by the port and starboard propulsion devices will produce an effective yaw component on the vessel and thus cause a certain amount of turning movement of the vessel. The bow of the vessel will turn during and in the direction of the lateral translation, which can be disadvantageous and undesirably require correction by the operator, for example requiring the operator to re-center the joystick to correct the unwanted yaw.

Figure 8A:
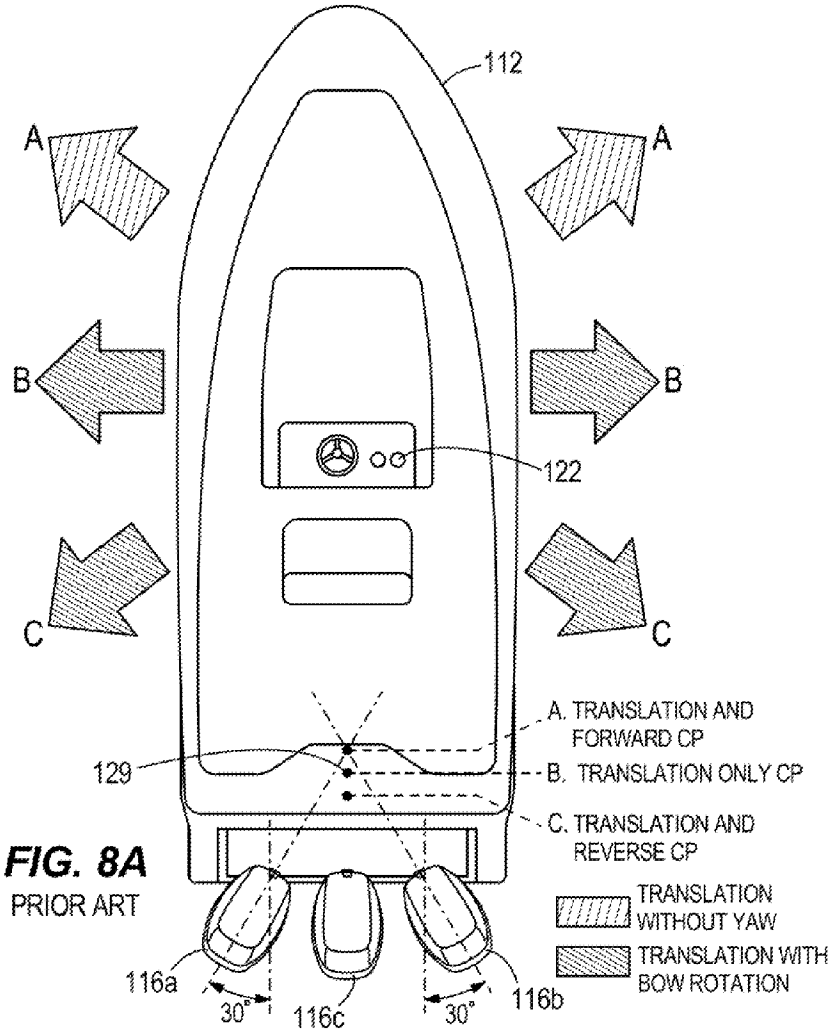
FIG. 8A PRIOR ART
FIG. 8A is a schematic depiction of a prior art system for laterally moving a marine vessel.

FIG. 8A depicts one example of such a prior art system 112. In this particular example, because of design constraints and/or mechanical limitations, port and starboard propulsion devices 116*a*, 116*b* on the marine vessel 112 have a maximum inward steering angle of thirty degrees from the longitudinal axis of the marine vessel 112. At this maximum inward steering angle, the forward and reverse thrusts provided by the port and starboard propulsion devices 116*a*, 116*b* extend along respective axes that intersect at a location that is forward of the center of turn 129 of the marine vessel 112. The intermediate propulsion device 116*c* typically is not operated during this maneuver. Thus, for all lateral movements in the directions of Arrows B and C, the thrusts of the marine propulsion devices 116*a*, 116*b* will cause a certain amount of turning movement of the vessel 112, causing the bow of the vessel 112 to turn during and in the direction of lateral translation of the marine vessel 112. Lateral movements in the direction of Arrows A will occur without turning movement of the vessel 12.

Figure 8B:
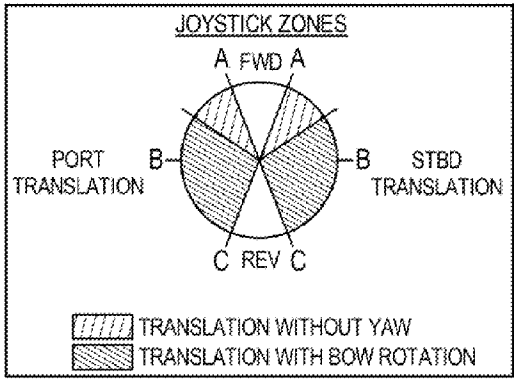
FIG. 8B PRIOR ART
FIG. 8B is a diagrammatic depiction of joystick zones into which a joystick is moved to achieve lateral movement of the marine vessel, according to the prior art system of FIG. 8A.

FIG. 8B corresponds to directions in which the operator will move the joystick 122 to request lateral translation of the vessel 112 in the direction of Arrows A, B, and C in FIG. 8A. As shown in Zones B and C, operator requests for transverse movements in the port or starboard directions will cause the vessel 112 to translate with yaw, resulting in a bow rotation. Because of mechanical limitations that are common on this type of prior art arrangement, the port and starboard propulsion devices 116*a*, 116*b* can only be oriented so that thrusts provided by these devices extend along axes that are directed inwardly towards each other to a common point that is located forwardly of the center of turn 129. Because this common point is forward of the center of turn 129, the noted unwanted yaw component on the vessel 112 occurs, causing the bow of the vessel 112 to turn in the direction of translation.

Figure 9A:
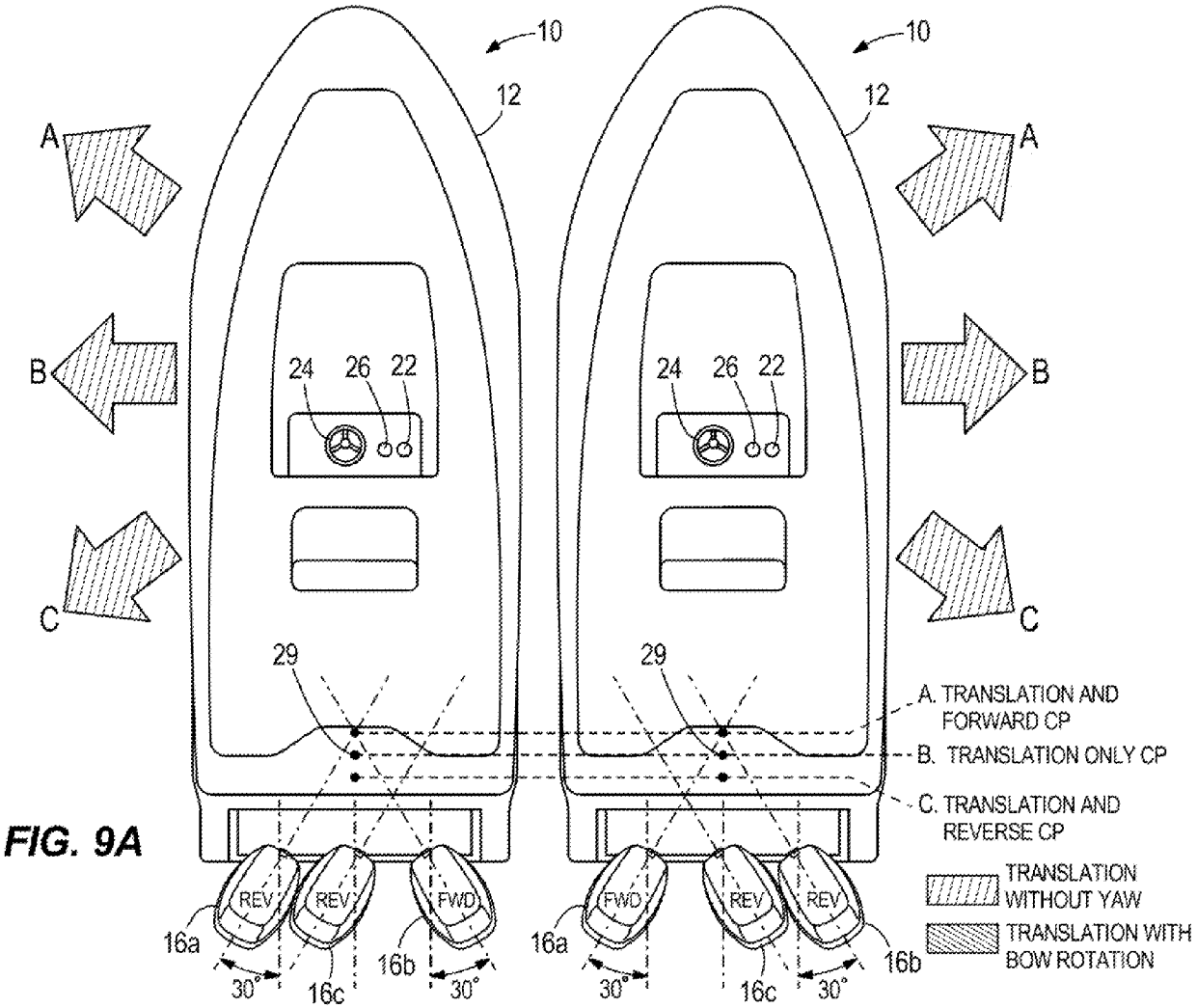
FIG. 9A is a schematic depiction of one example of a system for laterally moving a marine vessel according to the present disclosure.
Figure 9B:
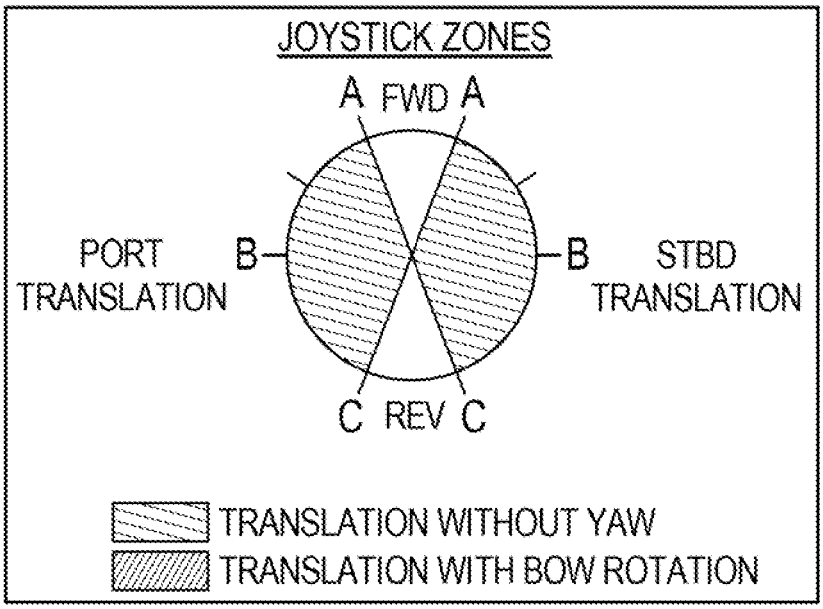
FIG. 9B is a diagrammatic depiction of joystick zones into which a joystick is moved to achieve lateral movement of the marine vessel, according to the system of FIG. 9A.

Referring to FIGS. 6, 9A and 98, according to the present disclosure, a control circuit 14 is provided that is uniquely programmed to operate the intermediate propulsion device 16*c* to counter the noted unwanted yaw component. In this example, the control circuit 14 has yaw section 17*c* that is configured to control the direction of thrust and steering orientation of the intermediate propulsion device 16*c* so that the intermediate propulsion device 16*c* is turned at an angle to the longitudinal axis L, for example parallel to the particular propulsion device 16*a* or 16*b* that is providing reverse thrust. The location and configuration of the yaw section 17*c* can vary. For example, it can be part of the programming and functionality of the steering control section 21*c* and the engine control section 31*c*. The particular angle and amount of reverse thrust can be controlled depending upon the situation and can be any angle between parallel to the longitudinal axis L and parallel to the propulsion device 16*a* or 16*b* providing reverse thrust. The intermediate propulsion device 16*c* is shifted into reverse gear and oriented to provide reverse thrust that is directed outwardly with respect to the marine vessel 12 and transverse to the longitudinal axis L. Application of the noted reverse thrust applies an opposing yaw component on the marine vessel 12, which counteracts the noted unwanted yaw component generated by the port and starboard propulsion devices 16*a*, 16*b*. In the areas of the joystick zones where no offset of yaw components on the marine vessel 12 are required (see e.g. zones A), the control circuit 14 can be programmed to operate the intermediate propulsion device 16*c* to remain in neutral gear.

When demand is applied to the intermediate propulsion device 16*c* in reverse gear, such demand can also be added to the forwardly running marine propulsion device 16*a* or 16*b* to compensate for the reverse component of the thrust of the intermediate propulsion device 16*c*. This leaves only a sidle component of the intermediate propulsion device 16*c* thrust, which is applied to the center of turn 29 of the marine vessel 12. In some examples, if there is additional thrust capability available in the intermediate propulsion device 16*c*, the yaw section 17*c* of the control circuit 14 can operate the intermediate propulsion device 16*c* to apply an additional yaw in a direction requested by the operator via the input device. Thus, the intermediate propulsion device 16*b* can be controlled by the control circuit 14 to any angle between the straight ahead position in alignment with the longitudinal axis L and parallel to the steering angle of the port/starboard propulsion device 16*a*, 16*b* in the direction of translation. The intermediate propulsion device 16*c* can then be placed in reverse gear to produce a thrust that creates a yaw moment opposite that caused by the force created by the port and starboard propulsion devices 16*a*, 16*b*. If there is demand left in reserve on the intermediate propulsion device 16*c*, it can be operated, by the control circuit 14 to apply additional yaw in that direction, if desired by the operator.

Figure 10A:
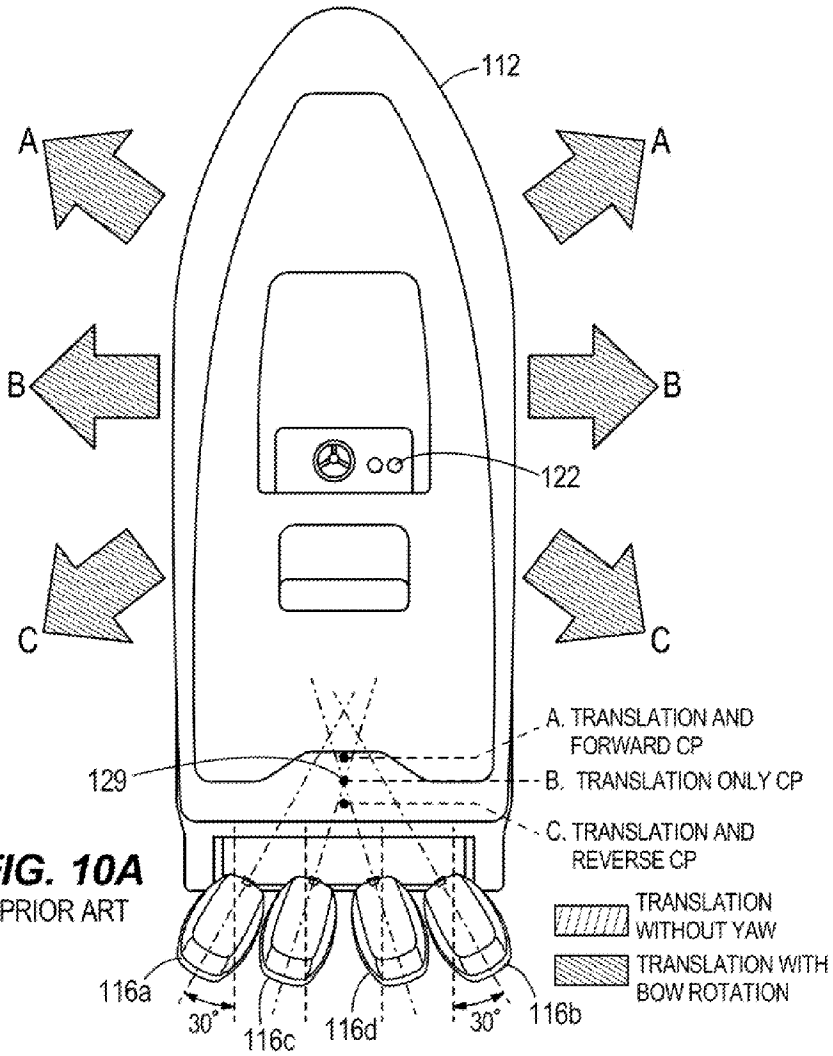
FIG. 10A PRIOR ART
FIG. 10A is a schematic depiction of another prior art system for lateral moving a marine vessel.

FIG. 10A depicts a prior art arrangement having four marine propulsion devices 116*a*, 116*b*, 116*c*, 116*d*. In this example, the center of turn 129 is located so far all on the vessel 112 that it is beyond the steering capability of the port and starboard propulsion devices 116*a*, 116*b*. The control circuit of the prior art arrangement thus often can only control steering orientation of the port and starboard propulsion devices 116*a*, 116*b* so that forward thrusts provided by the devices are aligned with axes that intersect each other at a common point that is located forwardly of the center of turn 129 of the marine vessel 112. The result is that operation of the propulsion devices 116*a*, 116*b* will cause the unwanted yaw component on the marine vessel 112 such that the bow of the marine vessel 112 will rotate in the direction of translation. The operator is left without the ability to counter this unwanted yaw movement, unless he or she returns the joystick 122 to the noted vertical position.

Figure 10B:
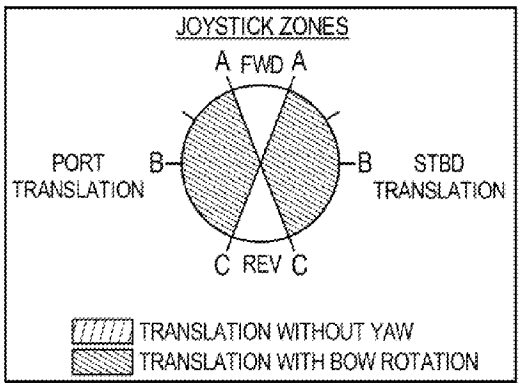
FIG. 10B PRIOR ART
FIG. 10B is a diagrammatic depiction of joystick zones into which a joystick is moved to achieve lateral movement of the marine vessel, according to the prior art system of FIG. 10A.

FIG. 10B corresponds to directions in which the operator will move the joystick 122 to request lateral translation of the vessel 112 in the direction of Arrows A. B, and C. As shown in Zones B and C, operator requests for transverse movements in the port or starboard directions will cause the vessel 112 to translate with yaw, causing bow rotation. Because of design constraints and/or mechanical limitations that are common on this type of prior art arrangement, the port and starboard propulsion devices 116*a*, 116*b* can only be oriented so that thrusts provided by these devices extend along axes that are directed inwardly towards each other to a common point that is located forwardly of the center of turn 129. Because this common point is forward of the center of turn 129, the noted unwanted yaw component on the vessel 112 occurs, causing the vessel 12 to turn in the direction of translation. Thus, the operator will be left without the ability to counter this unwanted yaw movement, unless he or she returns the joystick 122 to its vertical position.

Figure 11A:
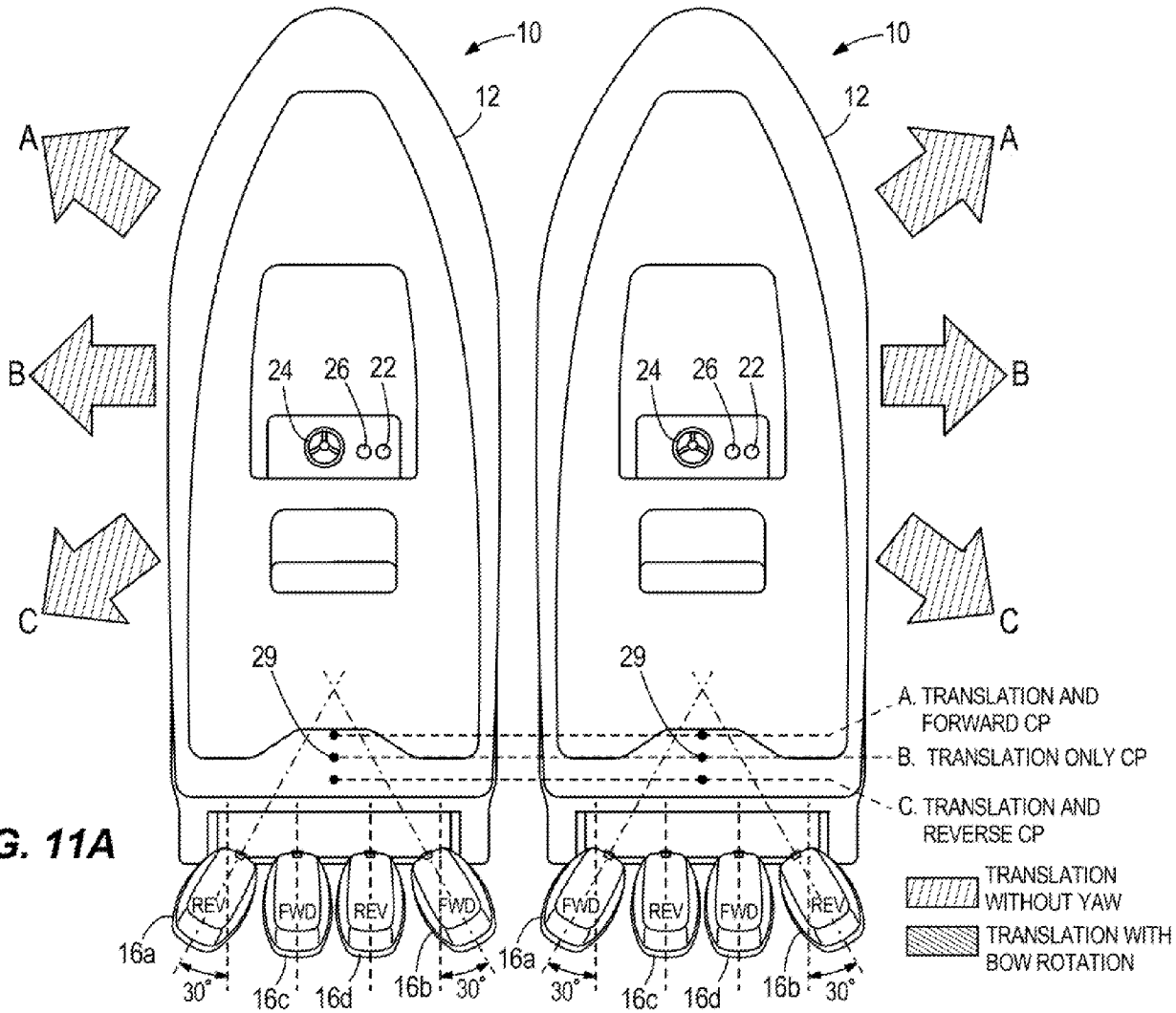
FIG. 11A is a schematic depiction of another example of a system for laterally moving a marine vessel according to the present disclosure.
Figure 11B:
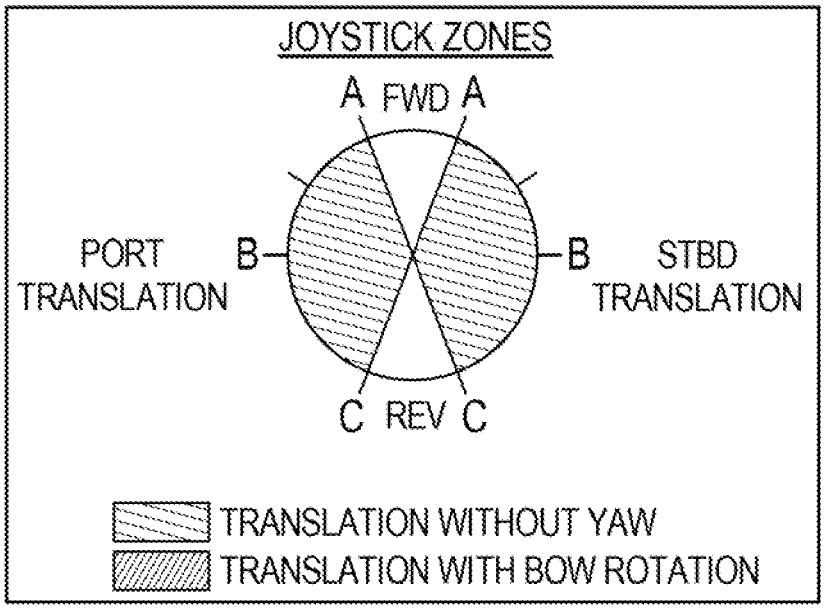
FIG. 11B is a diagrammatic depiction of joystick zones into which a joystick is moved to achieve lateral movement of the marine vessel, according to the system of FIG. 11A.

FIGS. 7, 11A and 11B depict another example according to the present disclosure wherein the control circuit 14 has one or more yaw sections 17*a*, 17*b*, 17*c*, 17*d* that are uniquely programmed to operate the intermediate propulsion devices, including the port intermediate propulsion device 16*c* and starboard intermediate propulsion device 16*d*, so as to provide thrusts that are parallel to the longitudinal axis L. The control circuit 14 operates the intermediate propulsion devices 16*c*, 16*d* in opposite gears so as to provide opposite thrusts (i.e. one forward and one reverse), thereby generating an opposing yaw component on the marine vessel 12, which counteracts the noted unwanted yaw component applied on the marine vessel 12 by the port and starboard propulsion devices 16*a*, 16*b*. As in the example shown in FIG. 9, if there is additional thrust capability available in the intermediate propulsion devices 16*c*, 16*d*, the control circuit 14 can operate the intermediate propulsion devices 16*c*, 16*d* to apply additional yaw in a direction requested by the operator via the input device, by for example rotating the handle 42 of the joystick 22. Thus, in this example, the intermediate propulsion devices 16*c*, 16*d* are oriented parallel to in longitudinal axis L during translation and operated to provide a differential thrust creating a yaw moment opposite that caused by the force applied by the propulsion devices 16*a*, 16*b*.

In an alternate example, which is not shown in FIG. 11, but would be understood by those having ordinary skill in the art, the port and starboard intermediate propulsion devices 16*c*, 16*d* can be oriented by one or more yaw section 17*c*, 17*d* so as to provide thrusts that are oriented along axes extending inwardly and intersecting at a common point located aftwardly of the center of turn 29, thereby counteracting the thrusts of the port and starboard propulsion devices 16*a*, 16*b*, which are oriented so as to provide thrusts directed inwardly at each other at a common point that is located forwardly of the center of turn 29.

The present disclosure thus provides examples of systems 10 for maneuvering marine vessels 12 that extend along a longitudinal axis L from bow to stern. In certain examples, the systems 10 comprise a plurality of steerable propulsion devices, e.g. 16*a*, 16*b*, 16*c*, and optionally 16*d*, that each generate forward and reverse thrusts. A control circuit 14 controls operational characteristics of each propulsion device in the plurality including steering orientation, magnitude of thrust, and direction of thrust. One or more input devices input to the control circuit 14 an operator's request for a lateral movement of the marine vessel 12 with respect to the longitudinal axis L. Upon the request for transverse movement, the control circuit 14 (1) controls steering orientation of the port and starboard propulsion devices 16*a*, 16*h* so that forward thrusts provided by the propulsion devices extend along axes that intersect at or forwardly of a center of turn 29 of the marine vessel 12; (2) operates one of the port and starboard propulsion devices to provide a forward thrust and the other of the port and starboard propulsion devices to provide a reverse thrust to thereby achieve the lateral movement and apply a resultant yaw component is applied on the marine vessel 12 during the lateral movement, and (3) operates the intermediate propulsion device 16*c* to apply an opposing yaw component on the marine vessel 12 that counteracts the resultant yaw component applied on the marine vessel 12 by the port and starboard propulsion devices 16*a*, 16*b*. In certain examples, the control circuit 14 controls at least one of the direction of thrusts and steering orientation of the intermediate propulsion device 16*c* to apply the opposing yaw component. The control circuit 14 can control the intermediate propulsion device 16*c* to provide a reverse thrust that is oriented, at an angle to the longitudinal axis L. The reverse thrust of the intermediate propulsion device 16*c* can be oriented parallel to the reverse thrust of the one of the port and starboard propulsion devices 16*a*, 16*b* that is operated in reverse gear. The control circuit 14 can be configured to control the intermediate propulsion device 16*c* to provide a magnitude of thrust that is sufficient to completely negate the resultant yaw component applied on the marine vessel 12 by the port and starboard propulsion devices 16*a*, 16*b*.

In certain examples, the user input device can be configured to input to the control circuit 14 an operator's request for turning movement of the marine vessel 12 with respect to the longitudinal axis L. Upon such a request for turning movement, the control circuit 14 can further control the intermediate propulsion device 16*c* to apply an additional yaw component on the marine vessel 12 that is in addition to the opposing yaw component and that causes the marine vessel 12 to yaw. The user input device can include a joystick 22 and the operator's request for turning movement of the marine vessel 12 can be input to the control circuit 14 by rotating the handle 42 of the joystick 22. In certain examples, the operator's request for lateral movement of the marine vessel 12 with respect to the longitudinal axes L can be input to the control circuit 14 by pivoting the joystick 22 out of the vertical position.

In certain examples, the system 10 can include a port intermediate propulsion device 16*c* and a starboard intermediate propulsion device 16*d*, which are both located between the port and starboard propulsion devices 16*a*, 16*b*. In these examples, the control circuit 14 can be configured to control a direction of thrust provided by each of the port intermediate propulsion devices 16*c* and the starboard intermediate propulsion device 16*d* to apply the noted opposing yaw component on the marine vessel 12. The control circuit 14 can control one of the intermediate propulsion devices 16*c*, 16*d* to apply a forward thrust and the other of the intermediate propulsion devices 16*c*, 16*d* to apply a reverse thrust, thereby applying, the opposing yaw component on the marine vessel 12. In certain other examples, the control circuit 14 can control steering orientation of the port intermediate propulsion device 16*c* and starboard intermediate propulsion device 16*d* to apply the noted opposing yaw component. Upon the request for lateral movement of the marine vessel 12, the control circuit 14 can control steering orientation of the port and starboard intermediate propulsion devices 16*c*, 16*d* so that forward and reverse thrusts provided by the port and starboard intermediate propulsion devices 16*c*, 16*d* are parallel to the longitudinal axis L. Alternately, the control circuit 14 can control the steering orientation of the intermediate propulsion devices 16*c*, 16*d* so that forward thrusts provided by the intermediate propulsion devices 16*c*, 16*d* extend along axes that intersect at a location that is aftward of a center of turn 29 of the marine vessel 12.

Figure 12:
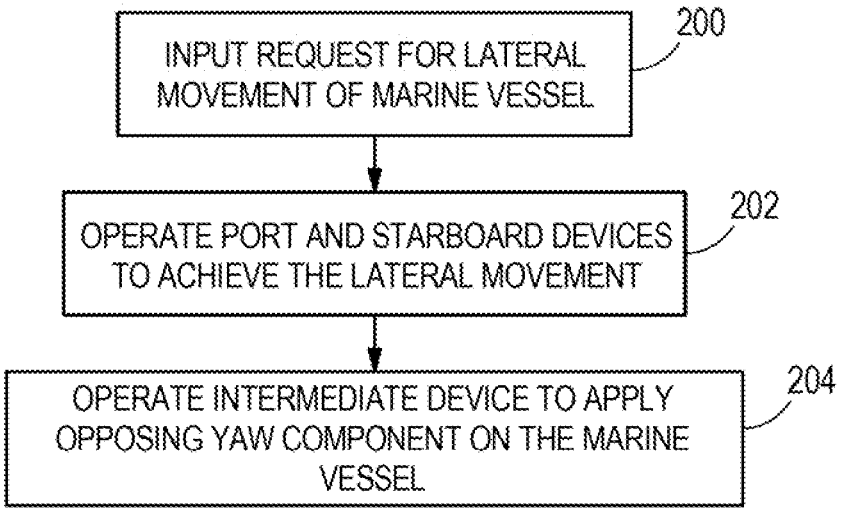
FIG. 12 is a flow chart depicting one example of a method of maneuvering a marine vessel according to the present disclosure.

FIG. 12 depicts one example of a method of maneuvering a marine vessel 12 according to the present disclosure. The method comprises, at step 200 inputting to the control circuit 14 an operator's request for lateral movement of the marine vessel 12 with respect to the longitudinal axis L. At step 202, the method comprises operating the port and starboard propulsion devices 16*a*, 16*b* to achieve the requested lateral movement. At step 204, the method comprises operating the intermediate propulsion device 16*c* to apply an opposing yaw component on the marine vessel 12 that counteracts the resultant yaw component applied on the marine vessel 12 by the port and starboard propulsion devices 16*a*, 16*b*.

Figure 13:
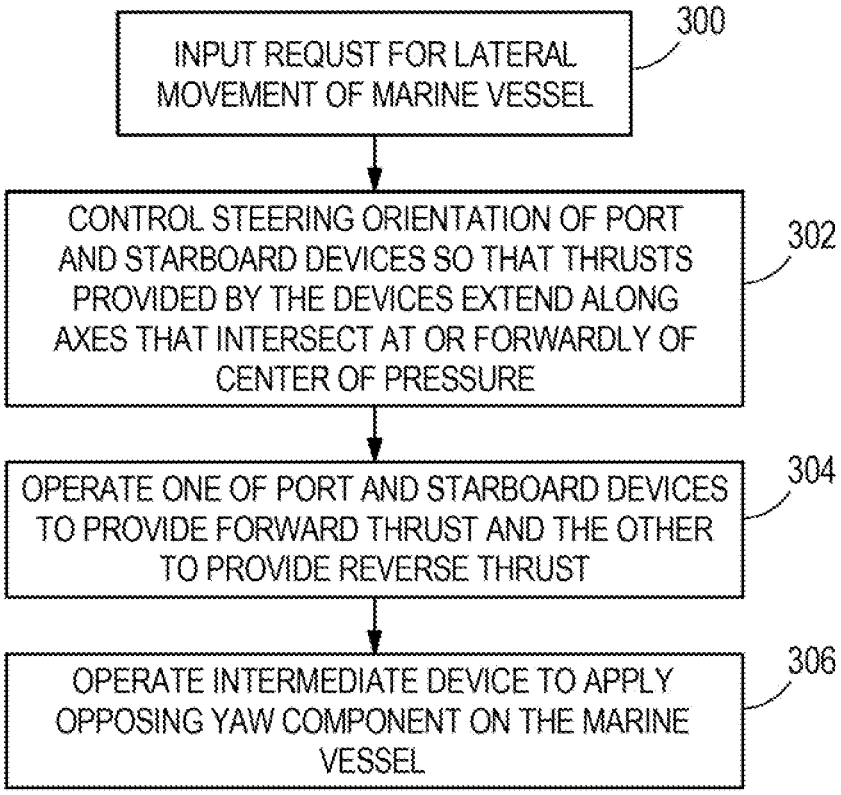
FIG. 13 is a flow chart depicting another example of a method of maneuvering a marine vessel according to the present disclosure.

FIG. 13 depicts another example of a method of maneuvering a marine vessel 12 according to the present disclosure. The method comprises, at step 300, inputting to the control circuit 14 an operator's request for lateral movement of the marine vessel 12 with respect to the longitudinal axis L. At step 302, the method comprises controlling the plurality of propulsion devices 16*a*, 16*b* to achieve the lateral movement by controlling steering orientation of the port and starboard propulsion devices 16*a*, 16*b* so that thrusts provided by the port and starboard propulsion devices 16*a*, 16*b* extend along axes that intersect at or forwardly of a center of turn 29 of the marine vessel 12. At step 304, the method comprises operating one of the port and starboard propulsion devices 16*a*, 16*b* to provide a forward thrust and operating the other of the port and starboard propulsion devices 16*a*, 16*b* to provide a reverse thrust so that a resultant yaw component is applied on the marine vessel 12 during the transverse movement. At step 306, the method comprises operating the intermediate propulsion device 16*c* to apply an opposing yaw component on the marine vessel 12 that counteracts the resultant yaw component applied on the marine vessel 12 by the port and starboard propulsion devices 16*a*, 16*b*.

In certain examples, the method can comprise controlling at least one of the steering orientation and direction of thrust of the intermediate propulsion device 16*c* to apply the opposing yaw component. In certain examples, the method can comprise controlling the intermediate propulsion device 16*c* to provide a reverse thrust that is oriented at an angle to the longitudinal axes L. The method can optionally further comprise orienting the reverse thrust of the intermediate propulsion device 16*c* parallel to the reverse thrust of one of the port and starboard propulsion devices 16*a*, 16*b* being operated in reverse gear. The method can further optionally comprise controlling the intermediate propulsion device 16*c* to apply a magnitude of thrust that is sufficient to negate the resultant yaw component applied on the marine vessel 12 by the port and starboard propulsion devices 16*a*, 16*b*.

In certain examples, wherein the intermediate propulsion device is one of a port intermediate propulsion device 16*c* and a starboard intermediate propulsion device 16*d* located between the port and starboard propulsion devices 16*a*, 16*b*, the method can comprise controlling a direction of thrust provided by each of the port intermediate propulsion device 16*c* and the starboard intermediate propulsion device 16*d* to apply the noted opposing yaw component. In these examples, the method can comprise controlling one of the intermediate propulsion devices 16*c*, 16*d* to apply a forward thrust and controlling the other of the intermediate propulsion devices 16*c*, 16*d* to apply a reverse thrust, thereby applying the noted opposing yaw component. In further examples, the method can comprise controlling steering orientation of the port intermediate propulsion device 16*c* and starboard intermediate propulsion device 16*d* to apply the opposing yaw component. In these examples, upon request for lateral movement of the marine vessel 12, the method can comprise controlling steering orientation of the intermediate propulsion devices 16*c*, 16*d* so that forward and reverse thrusts provided by the intermediate propulsion devices 16*c*, 16*d* are parallel to the longitudinal axes L. Alternately, the method can comprise controlling steering orientation of the intermediate propulsion devices 16*c*, 16*d* so that thrusts provided by the devices 16*c*, 16*d* extend along axes that intersect at a common point that is located rearwardly or aftwardly of a center of turn 29 of the marine vessel 12.

What is claimed is:

1. A system for maneuvering a marine vessel that extends along a longitudinal axis from a bow to a stern, the system comprising:

a plurality of steerable propulsion devices that each generate forward and reverse thrusts that propel the marine vessel, the plurality of steerable propulsion devices composing a port propulsion device, a starboard propulsion device and an intermediate propulsion device located between the port and starboard propulsion devices;

a control circuit that controls steering orientation, magnitude of thrust, and direction of thrust of each propulsion device in the plurality; and an input device that inputs to the control circuit an operator's request for lateral movement of the marine vessel with respect to the longitudinal axis;

wherein the control circuit controls the plurality of propulsion devices to achieve the transverse movement by controlling the steering orientation of the port and starboard propulsion devices so that thrusts provided by the port and starboard propulsion devices extend along axes that intersect at or forwardly of a center of turn of the marine vessel, operating one of the port and starboard propulsion devices to provide a forward thrust and operating the other of the port and starboard propulsion devices to provide a reverse thrust so that the lateral movement is achieved and a resultant yaw component is applied on the marine vessel during the lateral movement, and operating the intermediate propulsion device to apply an opposing yaw component on the marine vessel that counteracts the resultant yaw component applied on the marine vessel by the port and starboard propulsion devices.

2. The system according to claim 1, wherein the control circuit controls at least one of the steering orientation and the direction of thrust of the intermediate propulsion device to apply the apposing yaw component.

3. The system according to claim 2, wherein the control circuit controls the intermediate propulsion device to provide a reverse thrust that is oriented at an angle to the longitudinal axis.

4. The system according to claim 3, wherein the reverse thrust of the intermediate propulsion device is oriented parallel to the reverse thrust of said other of the port and starboard propulsion devices.

5. The system according to claim 4, wherein the control circuit controls the intermediate propulsion device to provide a magnitude of thrust that is sufficient to completely negate the resultant yaw component applied on the marine vessel by the port and starboard propulsion devices.

6. The system according to claim 1, wherein the opposing yaw component applied on the marine vessel by the intermediate propulsion device completely negates the resultant yaw component applied on the marine vessel by the port and starboard propulsion devices.

7. The system according to claim 6, wherein the user input device further inputs to the control circuit an operator's request for turning movement of the marine vessel with respect to the longitudinal axis, and wherein upon a request for turning movement of the marine vessel the control circuit further controls the intermediate propulsion device to apply an additional yaw component on the marine vessel that is in addition to the opposing yaw component and causes the marine vessel to yaw.

8. The system according to claim 7, wherein the user input device comprises a joystick and wherein the operator's request for turning movement of the marine vessel with respect to the longitudinal axis is input to the control circuit by rotating a handle of the joystick.

9. The system according to claim 1, wherein the user input device comprises a joystick and wherein the operator's request for lateral movement of the marine vessel with respect to the longitudinal axis is input to the control circuit by pivoting the joystick out of a vertical position.

10. The system according to claim 1, wherein the intermediate propulsion device is one of a port intermediate propulsion device and a starboard intermediate propulsion device located between the port and starboard propulsion devices.

11. The system according to claim 10, wherein the control circuit controls a direction of thrust provided by each of the port intermediate propulsion device and the starboard intermediate propulsion device to apply the opposing yaw component.

12. The system according to claim 11, wherein the control circuit controls one of the port intermediate propulsion device and the starboard intermediate propulsion device to apply a forward thrust and controls the other of the port intermediate propulsion device and starboard intermediate propulsion device to apply a reverse thrust, thereby applying the opposing yaw component.

13. The system according to claim 10, wherein the control circuit controls steering orientation of the port intermediate propulsion device and starboard intermediate propulsion device to apply the opposing yaw component.

14. The system according to claim 13, wherein upon the request for lateral movement of the marine vessel the control circuit controls the steering orientation of the port intermediate propulsion device and the starboard intermediate propulsion device so that forward and reverse thrusts provided by the port and starboard intermediate propulsion devices are parallel to the longitudinal axis.

15. The system according to claim 13, wherein upon the request for lateral movement of the marine vessel the control circuit controls the steering orientation of the port intermediate propulsion device and the starboard intermediate propulsion device so that forward thrusts provided by the port and starboard intermediate propulsion devices extend along axes that intersect at a location that is aftward of a center of turn of the marine vessel.

16. A method of maneuvering a marine vessel that extends along a longitudinal axis from a bow to a stern, the marine vessel having a plurality of steerable propulsion devices that each generate forward and reverse thrusts, the plurality of propulsion devices comprising a port propulsion device, a starboard propulsion device and an intermediate propulsion device located between the port and starboard propulsion devices, the method comprising: inputting to the control circuit an operator's request for lateral movement of the marine vessel with respect to the longitudinal axis; and controlling the plurality of propulsion devices to achieve the lateral movement by controlling steering orientation of the port and starboard propulsion devices so that thrusts provided by the port and starboard propulsion devices extend along axes that intersect at or forwardly of a center of turn of the marine vessel, operating one of the port and starboard propulsion devices to provide a forward thrust and operating, the other of the port and starboard propulsion devices to provide a reverse thrust so that the lateral movement is achieved and a resultant yaw component is applied on the marine vessel during the lateral movement, and operating the intermediate propulsion device to apply an opposing yaw component on the marine vessel that counteracts the resultant yaw component applied on the marine vessel by the port and starboard propulsion devices.

17. The method according to claim 16, comprising controlling at least one of the steering orientation and the direction of thrust of the intermediate propulsion device to apply the opposing yaw component.

18. The method according to claim 17, comprising controlling the intermediate propulsion device to provide a reverse thrust that is oriented at an angle to the longitudinal axis.

19. The method according to claim 18, comprising orienting the reverse thrust of the intermediate propulsion device parallel to the reverse thrust of said other of the port and starboard propulsion devices.

20. The method according to claim 19, comprising controlling the intermediate propulsion device to provide a magnitude of thrust that is sufficient to negate the resultant yaw component applied on the marine vessel by the port and starboard propulsion devices.

21. The method according to claim 16, wherein the intermediate propulsion device is one of a port intermediate propulsion device and a starboard intermediate propulsion device located between the port and starboard propulsion devices, and comprising controlling a direction of thrust provided by each of the port intermediate propulsion device and the starboard intermediate propulsion device to apply the opposing yaw component.

22. The method according to claim 21, comprising controlling one of the port intermediate propulsion device and the starboard intermediate propulsion device, to apply a forward thrust and controlling the other of the port intermediate propulsion device and starboard intermediate propulsion device to apply a reverse thrust, thereby applying the opposing yaw component.

23. The method according to claim 21, comprising controlling steering orientation of the port intermediate propulsion device and starboard intermediate propulsion device to apply the opposing yaw component.

24. The method according to claim 23, comprising, upon the request for lateral movement of the marine vessel, controlling steering orientation of the port intermediate propulsion device and the starboard intermediate propulsion device so that forward and reverse thrusts provided by the port and starboard intermediate propulsion devices are parallel to the longitudinal axis.

25. The method according to claim 23, comprising, upon the request for lateral movement of the marine vessel, controlling steering orientation of the port intermediate propulsion device and the starboard intermediate propulsion device so that thrusts provided by the port and starboard intermediate propulsion devices extend along axes that intersect at common point that is located rearwardly of a center of turn of the marine vessel.

* * * * *

UNITED STATES PATENT AND TRADEMARK OFFICE

CERTIFICATE OF CORRECTION

PATENT NO. : 9,132,903 B1
APPLICATION NO. : 14/038494
DATED : September 15, 2015
INVENTOR(S) : Kenneth G. Gable et al.

It is certified that error appears in the above-identified patent and that said Letters Patent is hereby corrected as shown below:

In the claims

In claim 1, column 14, line 45, “composing” should instead read --comprising--.

In claim 2, column 15, line 9, “apposing” should instead read --opposing--.

In claim 22, column 16, line 22, delete the “,” between “device” and “to”.

Signed and Sealed this
Ninth Day of February, 2016

Michelle K. Lee

Michelle K. Lee
*Director of the United States Patent and Trademark Office*